US005363828A

United States Patent [19]

Yamashita et al.

[11] Patent Number: 5,363,828

[45] Date of Patent: Nov. 15, 1994

[54] FUEL VAPOR PROCESSING APPARATUS OF INTERNAL COMBUSTION ENGINE

[75] Inventors: Osao Yamashita, Tokai; Yasunori Nakatsu, Aichi, both of Japan

[73] Assignee: Aisan Kogyo Kabushiki Kaisha, Ohbu, Japan

[21] Appl. No.: 92,821

[22] Filed: Jul. 19, 1993

[30] Foreign Application Priority Data

Jul. 22, 1992 [JP] Japan ..... 4-195221

[51] Int. Cl.[5] ..... F02M 25/08

[52] U.S. Cl. ..... 123/520; 123/198 D

[58] Field of Search ..... 123/518, 519, 520, 521, 123/198 D

[56] References Cited

U.S. PATENT DOCUMENTS

| | | | |
|---|---|---|---|
| 4,862,856 | 9/1989 | Yokoe et al. | 123/519 |
| 4,949,695 | 8/1990 | Uraniski et al | 123/520 |
| 5,056,494 | 10/1991 | Kayanuma | 123/519 |
| 5,146,902 | 9/1992 | Cook et al. | 123/198 D |
| 5,158,054 | 10/1992 | Otsuka | 123/198 D |
| 5,191,870 | 3/1993 | Cook | 123/198 D |
| 5,193,512 | 3/1993 | Steinbrenner et al. | 123/198 D |
| 5,220,898 | 6/1993 | Kidokoro et al. | 123/520 |
| 5,259,353 | 11/1993 | Nakai et al. | 123/520 |
| 5,259,355 | 11/1993 | Nakashima et al. | 123/520 |
| 5,261,379 | 11/1993 | Lipinski et al. | 123/198 D |
| 5,267,470 | 12/1993 | Cook | 123/520 |
| 5,275,144 | 1/1994 | Gross | 123/198 D |

FOREIGN PATENT DOCUMENTS

| | | | |
|---|---|---|---|
| 2-26754 | 2/1990 | Japan . | |
| 3-17169 | 2/1991 | Japan . | |
| 40318267 | 11/1992 | Japan | 123/518 |

*Primary Examiner*—E. Rollins Cross
*Assistant Examiner*—Thomas N. Moulis
*Attorney, Agent, or Firm*—Cushman, Darby & Cushman

[57] ABSTRACT

In a fuel vapor processing apparatus of a fuel tank for an internal combustion engine, fuel vapor in the fuel tank is supplied to a fuel vapor collecting canister filled with an absorbent, and is absorbed and collected therein, and the absorbed fuel in the canister is introduced into the downstream of a suction air throttle valve in a suction air passage through a control valve. The fuel vapor processing apparatus comprises a three-way valve having three openings which are connected to an air port of the canister, an upper air chamber of the fuel tank, and an air release port, a pressure sensor provided in such a manner that the pressure sensor is closer to the fuel tank than the control valve is, and a control unit which operates the three-way valve so as to communicate the air port of the canister with the upper air chamber of the fuel tank and to introduce a suction negative pressure into piping portions of the fuel vapor processing apparatus through the control valve, so that when the pressure in the piping portions reaches a predetermined value, the control unit closes the control valve, and that when a change of signals transmitted from the pressure sensor in accordance with time thereafter exceeds a predetermined range, the control unit judges it as abnormality.

2 Claims, 3 Drawing Sheets

FUEL VAPOR PROCESSING APPARATUS OF INTERNAL COMBUSTION ENGINE

BACKGROUND OF THE INVENTION

1. Industrial Field of the Invention

The present invention relates to a fuel vapor processing apparatus which is able to detect abnormality of a fuel tank or the like in an automobile.

2. Description of Related Art

Japanese Utility Model Unexamined Publication No. 3-17169 discloses a fuel vapor purge system in a fuel vapor processing apparatus of a fuel tank in which fuel vapor in the fuel tank is supplied to a fuel vapor collecting canister and absorbed/collected by an absorbent filled in the canister, and the absorbed fuel in the canister is introduced, via a purge line, to the downstream of a suction air throttle valve in a suction air passage. In this publication, there is proposed a self-diagnosis device of the fuel vapor purge system in the fuel vapor processing apparatus of the fuel tank, comprising means for judging whether or not the fuel vapor purge system is in a range for fuel purge, means for detecting the pressure in the purge line, and means for judging whether the system is normal or abnormal, on the basis of the pressure in the purge line which pressure is judged to be in the fuel-purge range or out of the range, by use of detection signals produced from the detecting means.

In the above-described conventional technique, self-diagnosis whether or not cracks exist in the purge line is carried out while an air port of the canister is kept open to communicate with the atmosphere. Consequently, it is impossible to detect abnormalities in a main body of the canister and the fuel tank. There has conventionally been a problem that abnormality all over the fuel vapor processing apparatus and piping portions cannot be detected.

SUMMARY OF THE INVENTION

It is therefore an object of the present invention to provide a fuel vapor processing apparatus which can solve the above-mentioned problem and can detect abnormality by shutting off a whole of a fuel tank, the fuel vapor processing apparatus and piping portions at the time of self-diagnosis.

In order to achieve the above object, according to a first aspect of the present invention, a fuel vapor processing apparatus of a fuel tank for an internal combustion engine, in which fuel vapor in the fuel tank is supplied to a fuel vapor collecting canister filled with an absorbent, and is absorbed and collected therein, and the absorbed fuel in the canister is introduced into the downstream of a suction air throttle valve in a suction air passage through a control valve, comprises a three-way valve having three openings which are connected to an air port of the canister, an upper air chamber of the fuel tank, and an air release port, respectively, a pressure sensor provided in such a manner that the pressure sensor is closer to the fuel tank than the control valve is, and a control unit which operates the three-way valve so as to communicate the air port of the canister with the upper air chamber of the fuel tank and to introduce a suction negative pressure into piping portions of the fuel vapor processing apparatus through the control valve, so that when the pressure in the piping portions reaches a predetermined value, the control unit closes the control valve, and that when a change of signals transmitted from the pressure sensor in accordance with time thereafter exceeds a predetermined range, the control unit judges it as abnormality.

Moreover, according to a second aspect of the invention, a fuel vapor processing apparatus of a fuel tank for an internal combustion engine, in which fuel vapor in the fuel tank is supplied to a fuel vapor collecting canister through a tank internal pressure control valve, and is absorbed and collected therein, and the absorbed fuel in the canister is introduced into the downstream of a suction air throttle valve in a suction air passage through a control valve, comprises a three-way valve having three openings which are connected to a diaphragm chamber of the tank internal pressure control valve, the downstream of the suction air throttle valve in the suction air passage, and an air release port, respectively, an open and close valve connected to an air port of the canister, a pressure sensor provided in such a manner that the pressure sensor is closer to the fuel tank than the control valve is, and a control unit which operates the three-way valve so as to communicate the diaphragm chamber of the tank internal pressure control valve with the downstream of the suction air throttle valve in the suction air passage, to close the open and close valve, and to introduce a suction negative pressure into piping portions of the fuel vapor processing apparatus through the control valve, so that when the pressure in the piping portions reaches a predetermined value, the control unit closes the control valve, and that when a change of signals transmitted from the pressure sensor in accordance with time thereafter exceeds a predetermined range, the control unit judges it as abnormality.

Furthermore, according to a third aspect of the invention, a fuel vapor processing apparatus of a fuel tank for an internal combustion engine, in which fuel vapor in the fuel tank is supplied to a fuel vapor collecting canister through a tank internal pressure control valve, and is absorbed and collected therein, and the absorbed fuel in the canister is introduced into the downstream of a suction air throttle valve in a suction air passage through a control valve, comprises a solenoid for opening the tank internal pressure control valve, an open and close valve connected to an air port of the canister, a pressure sensor provided in such a manner that the pressure sensor is closer to the fuel tank than the control valve is, and a control unit which operates the solenoid so as to open the tank internal pressure control valve, to close the open and close valve, and to introduce a suction negative pressure into piping portions of the fuel vapor processing apparatus through the control valve, so that when the pressure in the piping portions reaches a predetermined value, the control unit closes the control valve, and that when a change of signals transmitted from the pressure sensor in accordance with time thereafter exceeds a predetermined range, the control unit judges it as abnormality.

In the present invention, abnormality detection is basically carried out while the engine is on.

In a structure according to the first aspect of this invention, with the engine being on, the control unit operates the three-way valve so as to communicate the air port of the canister with the upper air chamber of the fuel tank, and also opens the control valve so that a suction-pipe negative pressure at the downstream of the suction air throttle valve in the suction air passage is introduced into piping portions of the fuel vapor processing apparatus. When the pressure in the piping portions reaches a predetermined negative pressure, the control unit closes the control valve. If any of the piping portions and the like has cracks and leaks the air, the pressure in the piping portions is drastically raised, and signals from the pressure sensor are abruptly changed. Consequently, the control unit monitors a change of the signals in accordance with time and judges whether the abnormality exists or not.

In a structure according to the second aspect of this invention, with the engine being on, the control unit operates the three-way valve so as to introduce a suction-pipe negative pressure at the downstream of the suction air throttle valve in the suction air passage into the diaphragm chamber of the tank internal pressure control valve, thereby opening the tank internal pressure control valve, and the control unit also closes the open and close valve connected to the air port of the canister. At the same time, the control unit opens the control valve so as to introduce the suction-pipe negative pressure into the piping portions of the fuel vapor processing apparatus.

When the pressure in the piping portions reaches a predetermined value, the control unit closes the control valve.

After that, the control unit monitors signals from the pressure sensor. When a change of the signals in accordance with time exceeds a predetermined range, the control unit judges it as abnormality that the piping portions or the like leak the air.

A structure according to the third aspect of the invention is similar to the structure according to the second aspect of the invention in many respects. Therefore, the function will be described in the preferred embodiment below.

DETAILED DESCRIPTION OF THE PREFERRED EMBODIMENTS

Figure 1:
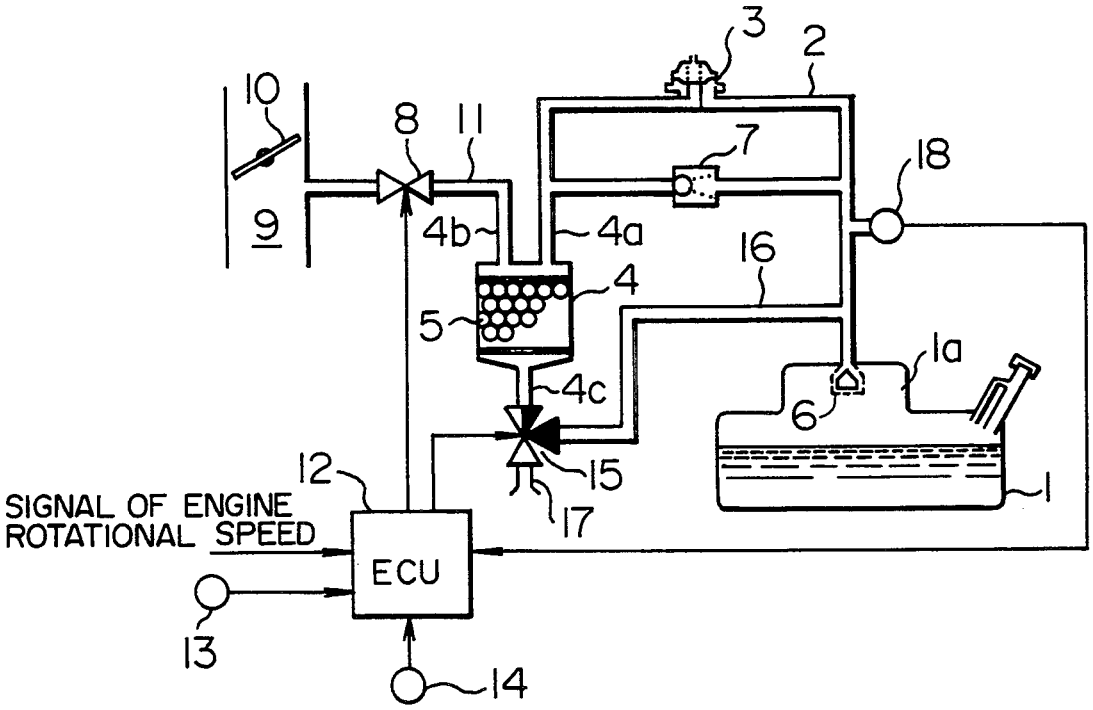
FIG. 1 is a diagram showing a structure of a first embodiment according to the present invention.

A first embodiment shown in FIG. 1 illustrates a structure according to the first aspect of the present invention. Referring to FIG. 1, a fuel tank 1 for a vehicle includes an upper air chamber 1*a*, and a vapor passage 2 communicates the upper air chamber 1*a* with a tank port 4*a* of a canister 4 via a tank internal pressure control valve 3.

An absorbent 5 composed of active carbon is filled in the canister 4. The canister 4 has a purge port 4*b* and an air port 4*c*. A float valve 6 is provided on an opened end portion of the vapor passage 2 inside of the upper air chamber la, and the float valve 6 is closed, for example, when the vehicle turns over.

The tank internal pressure control valve 3 is of the known structure which includes a diaphragm. When the pressure in the fuel tank 1 is at a predetermined value or less, the control valve 3 is closed, and when it exceeds the predetermined value, the control valve 3 is opened, to thereby communicate the upper air chamber 1*a* and the tank port 4*a* with each other.

A check valve 7 of the known structure for preventing breakage of the fuel tank due to negative pressure is connected in parallel to the tank internal pressure control valve 3, as shown in FIG. 1. The check valve 7 is opened when the pressure in the fuel tank 1 is not more than a predetermined value.

A control valve 8 is inserted in a purge passage 11 which connects the purge port 4*b* of the canister 4 with the downstream of a suction air throttle valve 10 of a suction air passage 9. Duty-ratio control of the control valve 8 is performed by a control unit 12 so as to control the purge flow rate.

The control unit 12 calculates an appropriate purge flow rate in accordance with engine operating conditions during normal operation on the basis of a signal of engine rotational speed and signals from a suction-pipe negative pressure sensor 13 and an exhaust-system air-fuel ratio (O2) sensor 14. Then, the control unit 12 regulates the duty ratio of the control valve 8.

A three-way valve 15 has three openings which are connected to the air port 4*c* of the canister 4, to a bypass passage 16 communicated with the upper air chamber 1*a* of the fuel tank 1, and to an air release port 17, as shown in FIG. 1. In this illustration, the opening connected to the bypass passage 16 is closed.

There is also provided a pressure sensor 18 which detects a pressure in the vapor passage 2 and outputs an electric signal of the detected pressure to the control unit.

In the first embodiment, abnormality detection of a fuel vapor processing apparatus is carried out in the following manner.

This abnormality detection is performed while the engine is on. First, the control unit 12 switches the three-way valve 15 so as to communicate the air port 4*c* with the bypass passage 16 and also to close the air release port 17. At the same time, the control valve 8 is opened under the duty-ratio control by the controll unit 12, and a suction-pipe negative pressure is introduced into the purge passage 11.

The introduced negative pressure is detected by the negative pressure sensor 18 and read by the control unit 12. When it reaches a predetermined negative pressure, the control unit 12 closes the control valve 8.

In this condition, all the piping in the fuel vapor processing apparatus including the fuel tank i and the canister 4 are communicated with one another. The control valve 8 and the three-way valve 15 shut the communication with the outside, and thus, all the piping are hermetically sealed.

Therefore, if none of these pipes have cracks and leak, the sealed negative pressure is seldom decreased, and even if there is a change, it is merely a pressure change owing to a temperature change.

If the piping have cracks or the like and leak, a change in the negative pressure in accordance with time exceeds a predetermined range, and consequently, the control unit 12 judges it as abnormality.

In the first embodiment, when the suction-pipe negative pressure is introduced at the time of abnormality detection the pressure change is monitored by the control unit 12 through the signals from the pressure sensor 18, and compared with a pressure change during normal operation, so that abnormality of the control valve 8 and the three-way valve 15 can be also detected.

When abnormality detection is finished, the control valve 8 is operated under duty-ratio control after the three-way valve 15 recovers the condition shown in FIG. 1. In this manner, fuel vapor is prevented from being released into the atmosphere through the air port 4*c* of the canister 4.

Figure 2A:
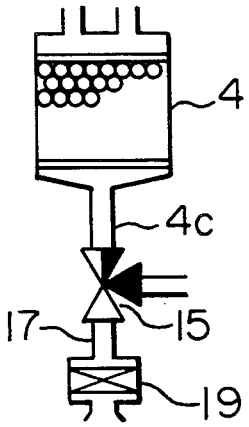
FIGS. 2A and 2B are partial modification diagrams in which the first embodiment shown in FIG. 1 is partially modified.
Figure 2B:
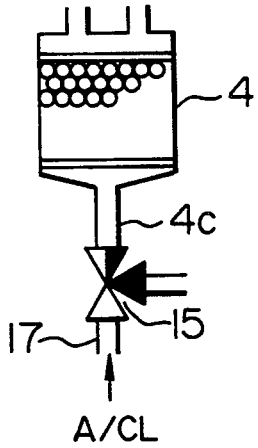

FIGS. 2A and 2B illustrate partially modified embodiments of the first embodiment shown in FIG. 1. FIG. 2A shows the case where a filter 19 is inserted in the air release port 17 of the three-way valve 15, and FIG. 2B shows the case where the air release port 17 of the three-way valve 15 is connected to an air cleaner A/CL.

Figure 3:
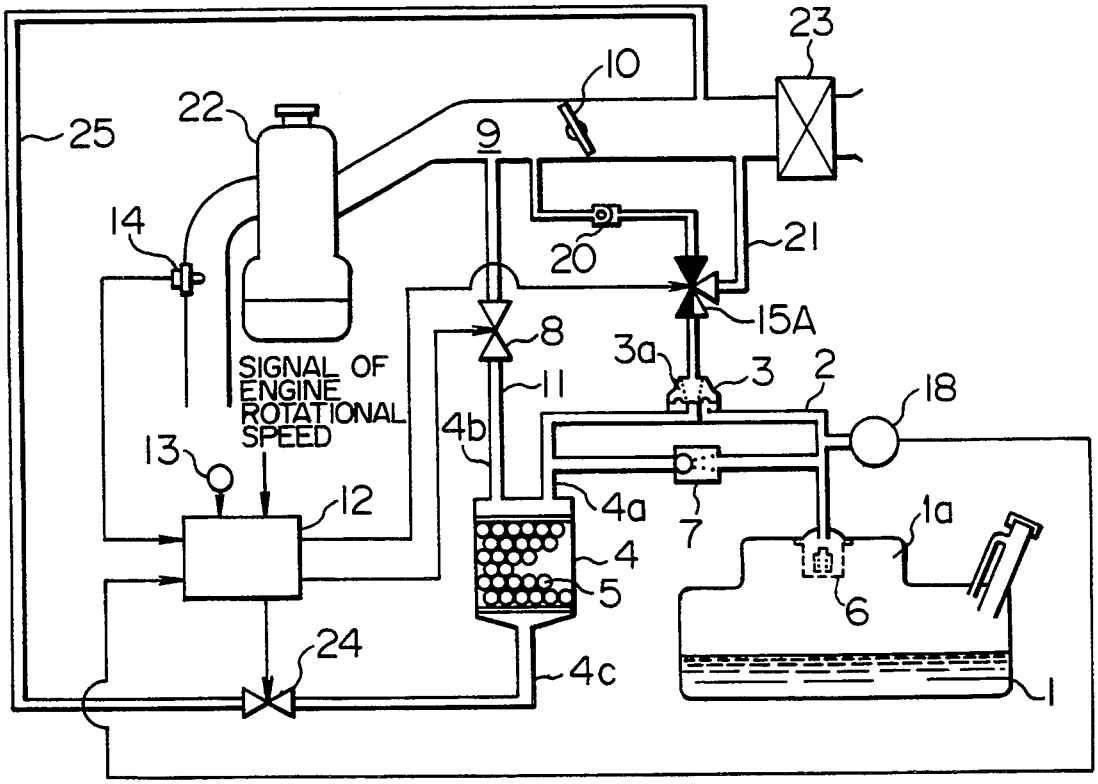
FIG. 3 is a diagram showing a structure of a second embodiment according to the invention.

FIG. 3 shows a second embodiment according to the present invention corresponding to a structure according to the second aspect of the invention.

In this drawing, component parts indicated by reference numerals 1 (a fuel tank) to 14 (an air-fuel ratio (O2) sensor) have substantially the same functions as those of the first embodiment indicated by common reference numerals in FIG. 1 so that the explanation thereof will be omitted.

A three-way valve 15A has three openings which are connected to a diaphragm chamber 3*a* of a tank internal pressure control valve 3, to the downstream of a suction air throttle valve 10 of a suction air passage 9 via a check valve 20, and to an air release port 21 connected to the upstream of the suction air throttle valve 10.

FIG. 3 further shows an engine 22 and an air cleaner 23 which is installed in an upstream portion of the suction air passage 9. An open and close valve (a solenoid valve) 24 operated by a control unit 12 is inserted in a passage 25 which connects an air port 4*c* of a canister 4 to the upstream of the suction air throttle valve 10 of the suction air passage 9.

In the second embodiment shown in FIG. 3, abnormality detection is carried out in the following manner.

This abnormality detection is performed while the engine is on. First, with the engine being on, the three-way valve 15A is switched from the illustrated condition so as to communicate the diaphragm chamber 3*a* with the downstream of the suction air throttle valve 10 of the suction air passage 9 and also to close the air release port 21.

As a result, a suction-pipe negative pressure is applied to the diaphragm chamber 3*a* through the check valve 20 so that the tank internal pressure control valve 3 is opened to communicate an upper air chamber 1*a* of the fuel tank 1 with the canister 4 via a vapor passage 2.

When the control unit 12 switches the three-way valve 15A in this manner, it simultaneously closes the open and close valve 24, and a control valve 8 is opened under duty-ratio control. Then, the suction-pipe negative pressure is applied, via the control valve 8, to piping portions of a fuel vapor processing apparatus including the fuel tank 1 and the canister 4.

The control unit 12 detects a negative pressure in these piping portions on the basis of a signal from a pressure sensor 18. When it reaches a predetermined negative pressure, the control unit 12 closes the control valve 8, to thereby keep the pressure in the piping portions negative.

After that, signals from the pressure sensor 18 are monitored by the control unit 12. If the piping portions leak due to cracks or the like, signals from the pressure sensor 18 are abruptly changed in accordance with time, so that when the pressure change exceeds a predetermined range, the control unit 12 judges it as abnormality of the piping portions.

In this manner, abnormality in all the piping portions of the fuel vapor processing apparatus is detected.

In the second embodiment, during abnormality detection, the three-way valve 15A is switched to close the open and close valve 24 and to operate the control valve 8 under duty-ratio control, thereby introducing the suction-pipe negative pressure into the piping portions of the fuel vapor processing apparatus. When a change of the negative pressure until the introduced negative pressure reaches a predetermined value is monitored by the control unit 12 on the basis of outputs from the pressure sensor 18, it is also possible to detect whether the open and close valve 24, the three-way valve 15A, the tank internal pressure control valve 3, the control valve 8 and so forth are abnormal or not. This is judged by the control unit 12 when the change of the negative pressure is compared with a pressure change during normal operation.

When abnormality detection is finished, the open and close valve 24 is opened, and thereafter, the control valve 8 is operated under the duty-ratio control, and the three-way valve 15A is switched to recover the condition shown in FIG. 3.

Figure 4:
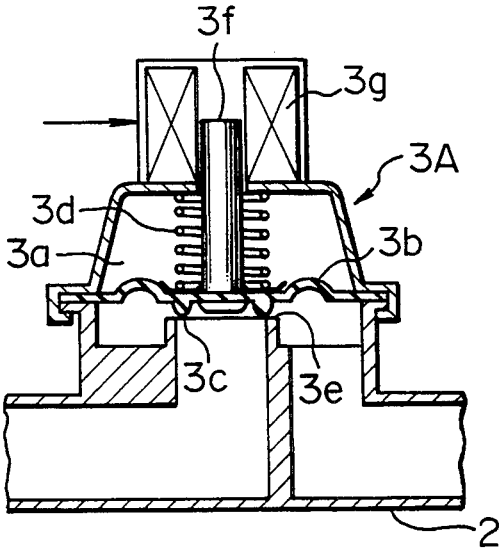
FIG. 4 is a vertical cross-sectional view showing a tank internal pressure control valve in a third embodiment according to the invention.

FIG. 4 illustrates an essential portion of a third embodiment according to the present invention which is obtained by partially modifying the embodiment shown in FIG. 3. In the third embodiment, the three-way valve 15A and the check valve 20 in the second embodiment are not used, and the tank internal pressure control valve 3 is substituted by a tank internal pressure control valve 3A shown in FIG. 4. This third embodiment corresponds to the third aspect of the invention.

The tank internal pressure control valve 3A comprises a diaphragm 3*b* integrally formed with a valve body 3*c*, a spring 3*d* provided in a diaphragm chamber 3*a* so as to urge the diaphragm 3*b* downwardly, a valve seat 3*e* which functions cooperatively with the valve body 3*c*, and a solenoid 3*g* which upwardly attracts a plunger 3*f* attached to the diaphragm 3*b*.

During normal operation, the solenoid 3*g* is not magnetized. The pressure in a fuel tank 1 is applied to the lower surface of the diaphragm 3*b* through a vapor passage 2, and when the applied pressure exceeds a predetermined value, the diaphragm 3*b* is moved upwardly against the force of the spring 3*d*, and the tank internal pressure control valve 3A is opened.

As a result, fuel vapor flows from an upper air chamber 1*a* of the fuel tank 1 into a canister 4 through the vapor passage 2, and is absorbed and collected by an absorbent 5.

At the time of abnormality detection, with the engine being on, a control unit 12 supplies an excitation current to the solenoid 3*g* of the tank internal pressure control valve 3A so that the solenoid 3*g* attracts the plunger 3*f* upwardly against the force of the spring 3*d*, to thereby open the tank internal pressure control valve 3A and the control unit 12 also closes an open and close valve 24.

At the same time, a control valve 8 is opened cunder duty-ratio control, and a suction-pipe negative pressure is introduced into piping portions of a fuel vapor processing apparatus.

The control unit 12 checks signals from a pressure sensor 18. When the pressure in the piping portions reaches a predetermined negative pressure, the control unit 12 closes the control valve 8, to thereby keep the pressure in the piping portions negative.

The control unit 12 monitors signals from the pressure sensor 18 after that. If the piping portions leak due to cracks, the pressure is drastically raised, and signals from the pressure sensor 18 are abruptly changed. Therefore, when the pressure change in accordance with time exceeds a predetermined range, the control unit 12 judges it as abnormality of the piping portions.

Figure 5:
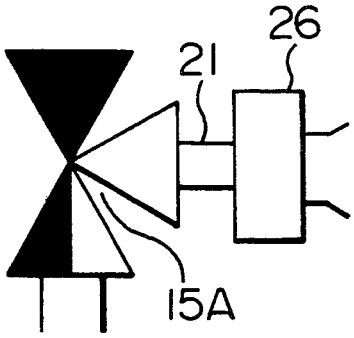
FIG. 5 is a partial modification diagram in which the embodiment shown in FIG. 3 is partially modified.

FIG. 5 illustrates an example in which the air release port 21 of the three-way valve 15A in the second embodiment shown in FIG. 3 is communicated with the atmosphere through an air filter 26 in place of the air cleaner 23 in the suction air passage.

Figure 6:
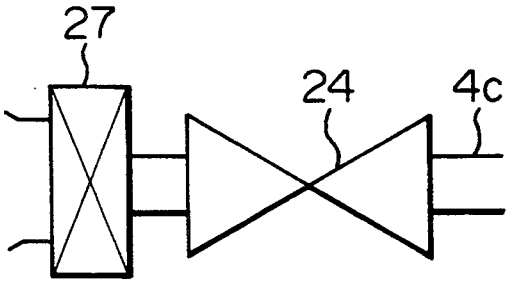
FIG. 6 is another partial modification diagram in which the embodiment shown in FIG. 3 is partially modified.

Further, FIG. 6 illustrates an example in which the atmospheric air side of the open and close valve 24 connected to the air port 4c of the canister 4 in the second embodiment shown in FIG. 3 is not communicated with the suction air passage 9 but opened toward the atmosphere through an air filter 27.

According to the present invention of the above-described structure, abnormality in all the piping portions of the fuel vapor processing apparatus including the fuel tank and the canister can be detected.

What is claimed is:

1. A fuel vapor processing apparatus of a fuel tank for an internal combustion engine, in which fuel vapor in the fuel tank is supplied to a fuel vapor collecting canister filled with an absorbent, and is absorbed and collected therein, and the absorbed fuel in the canister is introduced into the downstream of a suction air throttle valve in a suction air passage through a control valve, said fuel vapor processing apparatus comprising:

a three-way valve having three openings which are connected to an air port of the canister, an upper air chamber of the fuel tank, and an air release port;

a pressure sensor provided in such a manner that the pressure sensor is closer to the fuel tank than said control valve is; and a control unit which operates said three-way valve so as to communicate the air port of the canister with the upper air chamber of the fuel tank and to introduce a suction negative pressure into piping portions of the fuel vapor processing apparatus through said control valve, so that when the pressure in said piping portions reaches a predetermined value, the control unit closes the control valve, and that when a change of signals transmitted from the pressure sensor in accordance with time thereafter exceeds a predetermined range, the control unit judges it as abnormality.

2. A fuel vapor processing apparatus of a fuel tank for an internal combustion engine, in which fuel vapor in the fuel tank is supplied to a fuel vapor collecting canister through a tank internal pressure control valve, and is absorbed and collected therein, and the absorbed fuel in the canister is introduced into the downstream of a suction air throttle valve in a suction air passage through a control valve, said fuel vapor processing apparatus comprising:

a three-way valve having three openings which are connected to a diaphragm chamber of the tank internal pressure control valve, the downstream of the suction air throttle valve in the suction air passage, and an air release port;

an open and close valve connected to an air port of the canister;

a pressure sensor provided in such a manner that said pressure sensor is closer to the fuel tank than said control valve is; and a control unit which operates said three-way valve so as to communicate the diaphragm chamber of the tank internal pressure control valve with the downstream of the suction air throttle valve in the suction air passage, to close said open and close valve, and to introduce a suction negative pressure into piping portions of the fuel vapor processing apparatus through said control valve, so that when the pressure in said piping portions reaches a predetermined value, the control unit closes the control valve, and that when a change of signals transmitted from the pressure sensor in accordance with time thereafter exceeds a predetermined range, the control unit judges it as abnormality.

* * * * *